US008122855B2

(12) United States Patent
Klausmann et al.

(10) Patent No.: US 8,122,855 B2
(45) Date of Patent: Feb. 28, 2012

(54) BOILER

(75) Inventors: Werner Klausmann, Wetter (DE); Gunthard Görge, Stadtallendorf (DE); Roger Dönges, Frankenau (DE)

(73) Assignee: Viessmann Werke GmbH & Co. KG, Allendorf (DE)

( * ) Notice: Subject to any disclaimer, the term of this patent is extended or adjusted under 35 U.S.C. 154(b) by 793 days.

(21) Appl. No.: 12/159,833

(22) PCT Filed: Jan. 9, 2007

(86) PCT No.: PCT/DE2007/000038
§ 371 (c)(1),
(2), (4) Date: Aug. 7, 2008

(87) PCT Pub. No.: WO2007/079730
PCT Pub. Date: Jul. 19, 2007

(65) Prior Publication Data

US 2009/0056647 A1 Mar. 5, 2009

(30) Foreign Application Priority Data

Jan. 11, 2006 (DE) ..... 10 2006 001 590

(51) Int. Cl.
*F24H 1/34* (2006.01)

(52) U.S. Cl. ..... 122/18.1; 122/31.1

(58) Field of Classification Search ..... 122/18.1, 122/31.1, 31.2, 33
See application file for complete search history.

(56) References Cited

U.S. PATENT DOCUMENTS

| | | | | | |
|---|---|---|---|---|---|
| 3,529,579 | A | * | 9/1970 | Wanson | 122/248 |
| 4,102,309 | A | * | 7/1978 | Viessmann | 122/136 R |
| 4,157,698 | A | * | 6/1979 | Viessmann | 122/136 R |
| 4,169,431 | A | * | 10/1979 | Viessmann | 122/136 R |
| 4,188,917 | A | * | 2/1980 | Asman | 122/134 |
| 4,287,857 | A | * | 9/1981 | Schnitzer | 122/23 |
| 4,771,762 | A | * | 9/1988 | Bridegum | 122/14.22 |
| 4,869,208 | A | * | 9/1989 | Adams | 122/214 |
| 5,471,957 | A | * | 12/1995 | Brady et al. | 122/367.1 |

(Continued)

FOREIGN PATENT DOCUMENTS

DE 2818257 A 11/1978

(Continued)

OTHER PUBLICATIONS

Viesmann, "Vitolaplus 300—Oil Fired Unit Condensing Boiler—Rated Output 19.4—29.2 kW—Vitoplus 300—Oil Fired Wall-Mounted Condensing Boiler—Rated Output: 12.9—23.5 kW", Mar. 2005, http://www.viessmann.de/web/germany/coe/ppr-vitolaplus-vitoplus.pdf/$FILE/ppr-vitolaplus-vitoplus.pdf, p. 16.

*Primary Examiner* — Gregory A Wilson
(74) *Attorney, Agent, or Firm* — The Webb Law Firm

(57) ABSTRACT

The invention relates to a boiler comprising a combustion chamber which is surrounded at least in part by a combustion gas flue that is embodied as a primary heat exchanger. The combustion gas flue is enclosed at least in part by a water-conducting housing while a water-conducting secondary heat exchanger that is hydraulically connected to the housing is mounted downstream of the combustion gas flue. According to the invention, the combustion chamber is surrounded at least in part by the secondary heat exchanger.

11 Claims, 4 Drawing Sheets

U.S. PATENT DOCUMENTS

| | | | | |
|---|---|---|---|---|
| 6,152,083 | A * | 11/2000 | Bridegum | 122/18.3 |
| 6,945,197 | B2 * | 9/2005 | Ryoo | 122/15.1 |
| 7,267,083 | B2 * | 9/2007 | Le Mer et al. | 122/32 |
| 7,281,497 | B2 * | 10/2007 | Le Mer et al. | 122/31.2 |
| 7,614,366 | B2 * | 11/2009 | Arnold et al. | 122/18.1 |
| 7,909,005 | B2 * | 3/2011 | Le Mer et al. | 122/31.1 |

FOREIGN PATENT DOCUMENTS

| | | | |
|---|---|---|---|
| DE | 3425667 | A1 | 1/1986 |
| DE | 10026550 | C1 | 11/2001 |
| EP | 0699872 | A1 | 3/1996 |
| NL | 8100641 | A | 9/1982 |

* cited by examiner

BOILER

BACKGROUND OF THE INVENTION

1) Field of the Invention

The invention relates to a boiler having a combustion chamber with a heat insulating block.

2) Description of Related Art

German Patent Application Publication No. DE 34 25 667 A1 discloses a boiler having primary and secondary heat exchangers, wherein the secondary heat exchanger is located behind the combustion chamber when viewed in the axial direction, hence a compact design is not possible because of the necessary burn-up length.

SUMMARY OF THE INVENTION

A boiler of the type specified initially is manufactured and sold by the applicant under the product name "Vitolaplus" and is accordingly known (see FIG. 3).

The "Vitolaplus" boiler consists of a combustion chamber which is surrounded at least in part by a combustion gas flue that is embodied as a primary heat exchanger. In this case, in order to ensure clean combustion, the combustion chamber must have a certain length, the so-called burn-up length. The aforementioned combustion gas flue is furthermore surrounded at least in part by a water-conducting housing while a water-conducting secondary heat exchanger that is hydraulically connected to the housing, that is configured as helically tube-shaped and through which heating gas flows radially from inside to outside, is mounted downstream of the combustion gas flue. The heating gas coming from the burner thus flows initially from the combustion chamber into the combustion gas flue and there releases heat to the water in the housing. Following the combustion gas flue, the heating gas flows radially from inside to outside through the flow gap of the downstream, flue-gas-condensing helically tubular heat exchanger and there again, at a correspondingly lower temperature level, releases heat to the water flowing through the secondary heat exchanger.

From the heat engineering point of view, this condensing boiler has proved extremely successful. It has a very high normal supply level of up to 103%.

The object of the invention is to configure a boiler of the type specified initially more compactly in order to reduce the required space and therefore the required mounting volume, whilst ensuring the necessary burn-up length inside the combustion chamber.

According to the invention, it is also provided that the combustion chamber is surrounded at least in part by the condensing secondary heat exchanger.

The stipulation "at least in part" expresses the fact that not all the parts of the secondary heat exchanger must surround the combustion chamber, wherein the larger the enclosed part, naturally the better the invention is implemented.

In other words, the compactness of the boiler according to the invention is achieved by at least a large part of the secondary heat exchanger surrounding the combustion chamber, i.e. the external dimensions of the heat exchanger are now necessarily defined by the aforementioned burn-up length of the combustion chamber and not by the size of the secondary heat exchanger. In this way, the entire boiler can be configured as shorter when viewed in the axial direction of the combustion chamber. In addition, the heat released by the combustion chamber is now also supplied to the secondary heat exchanger, whereby a further improvement in the utilisation of heat is achieved. The silencer structure provided in the known prior art (Vitolaplus) behind the combustion chamber is omitted or is mounted, if required, downstream of the secondary heat exchanger.

As in the Vitolaplus design, in the solution according to the invention it is preferably but not necessarily provided that the secondary heat exchanger is configured as helically tube-shaped and heating gas flows radially therethrough from inside to outside. In this case, in particular, the constructively advantageous solution is obtained that the combustion chamber is surrounded by the secondary heat exchanger, forming an annular chamber, wherein the combustion gas flue preferably opens out directly into the annular chamber. This will be explained more precisely further below.

It is particularly preferably provided in this case that the combustion chamber comprises a combustion chamber sleeve which is configured to be withdrawable from the combustion chamber in the axial direction. This stipulation makes it possible if necessary, since the combustion chamber is surrounded by the secondary heat exchanger at least in part, to clean this (the secondary heat exchanger) and also the combustion gas flue with the combustion chamber sleeve removed. The combustion chamber sleeve in which the heat insulating block can also be arranged depending on the embodiment of the boiler (a pot-type combustion chamber is obtained in this way) is therefore also used to a certain extent as a flue gas flow guide or closure element and at the same time forms an inner boundary wall for the aforementioned annular space and the combustion gas flue.

BRIEF DESCRIPTION OF THE DRAWINGS

The boiler according to the invention including its advantageous further developments according to the dependent claims is explained in detail hereinafter with reference to the drawings showing two exemplary embodiments.

In the figures

DETAILED DESCRIPTION OF THE INVENTION

Figure 1:
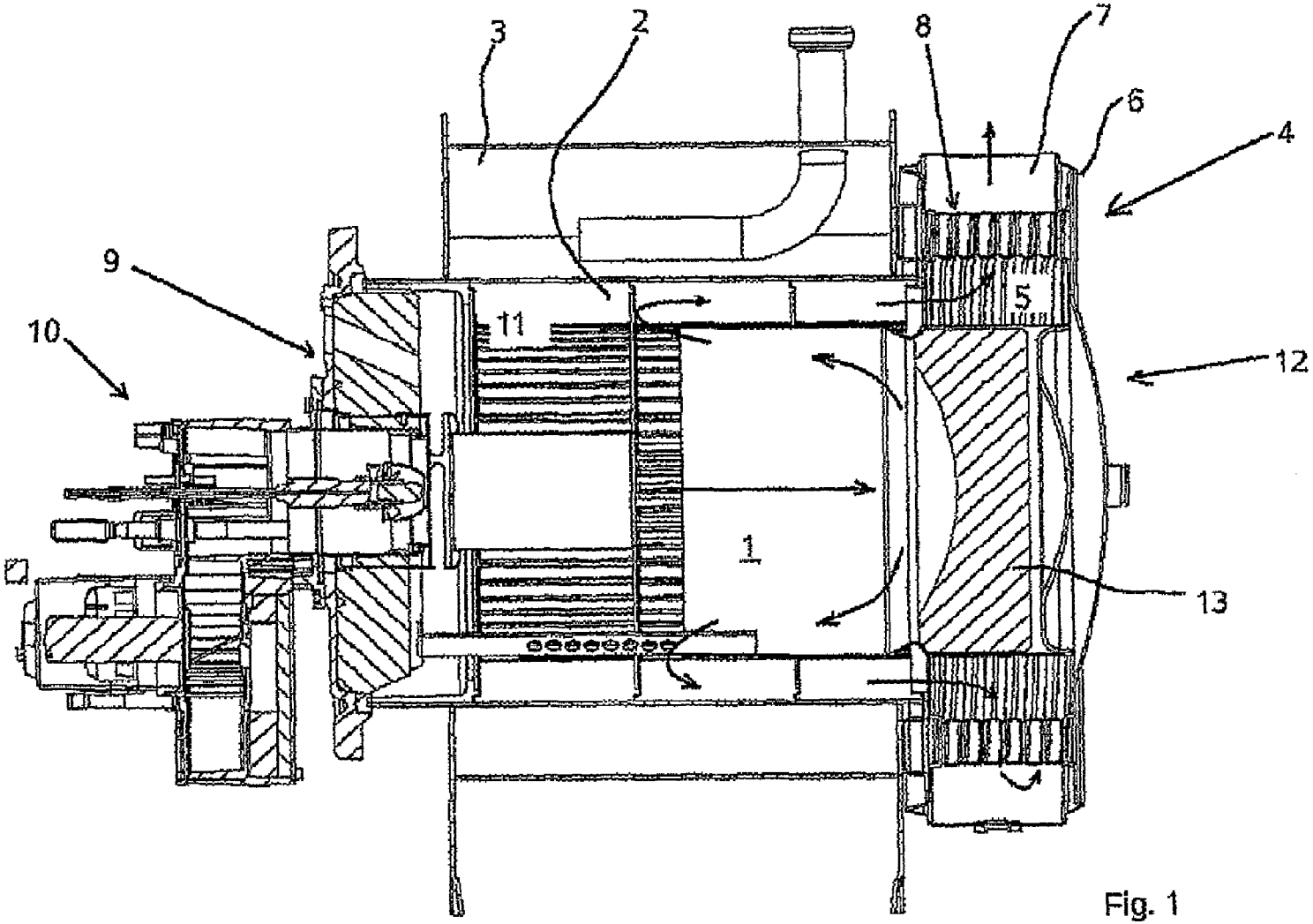
FIG. 1 shows, in sectional view, a first embodiment of the boiler according to the invention in which the secondary heat exchanger is located on the side of the boiler facing away from the burner.
Figure 2:
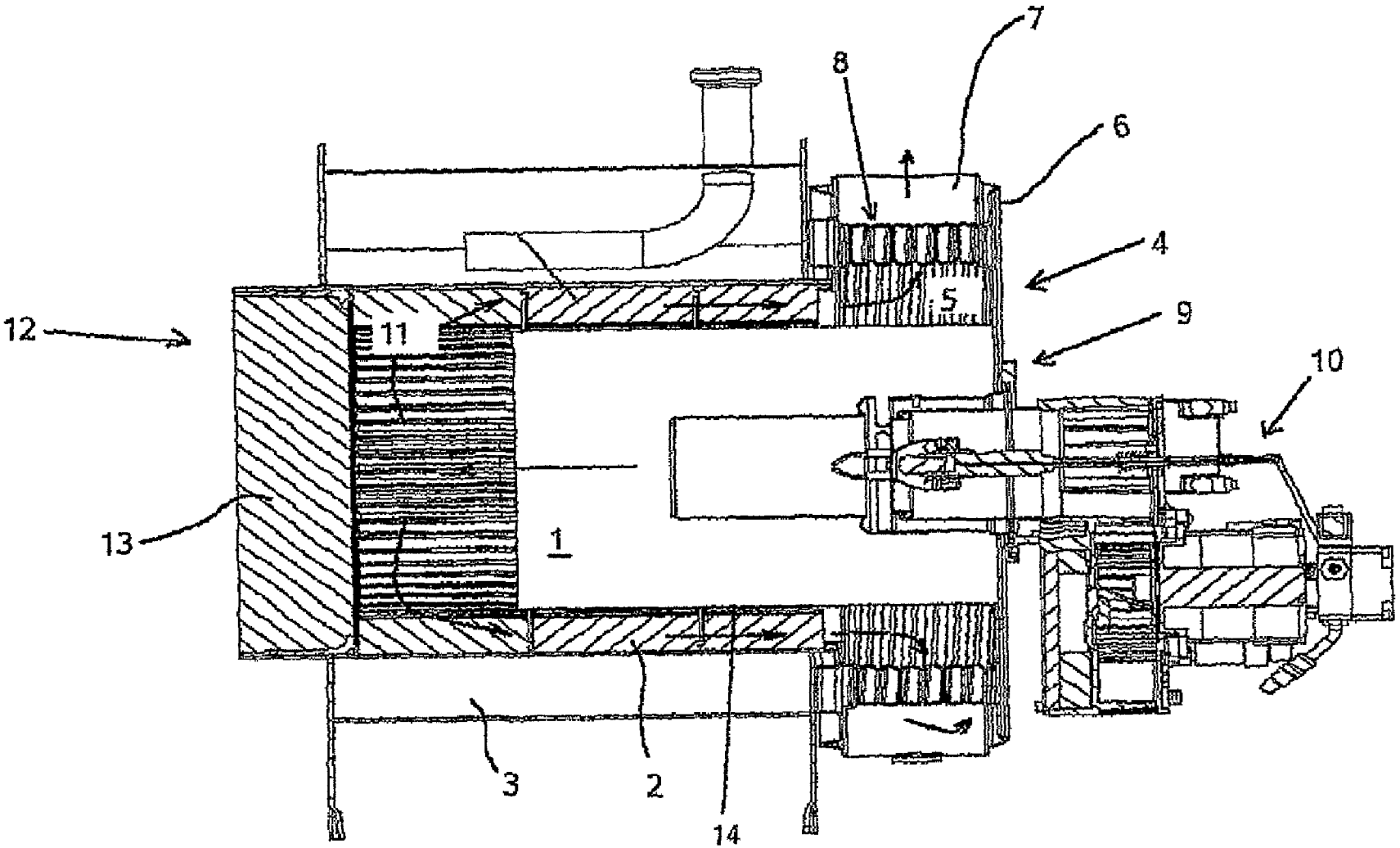
FIG. 2 shows, in sectional view, a second embodiment of the boiler according to the invention in which the secondary heat exchanger is located on the same side of the boiler as the burner.

FIGS. 1 and 2 show two different embodiments of the boiler according to the invention. If no further indications are given, the following explanations always apply to both embodiments.

The boiler according to the invention consists of a cylindrical combustion chamber 1, wherein this is surrounded concentrically at least in part by a combustion gas flue 2 embodied as a primary heat exchanger and wherein the combustion gas flue 2 is in turn surrounded concentrically at least in part by a water-conducting housing 3. A water-conducting secondary heat exchanger 4 that is connected hydraulically to the housing 3, that is configured as helically tube-shaped in this case and through which heating gas flows radially from inside to outside, is mounted downstream of the combustion gas flue 2. This secondary heat exchanger 4 is located in a housing 6 that defines on the one hand an annular chamber 5 still to be explained and on the other hand, another annular-chamber-shaped flue gas collecting chamber 7 surrounding the secondary heat exchanger 4, wherein the flue gas collecting chamber 7 has a flue gas extraction connection (not explicitly shown but indicated by the upwardly pointing arrow) for removing the flue gas. If necessary, a silencer can be connected to this flue gas extraction connection.

Figure 3:
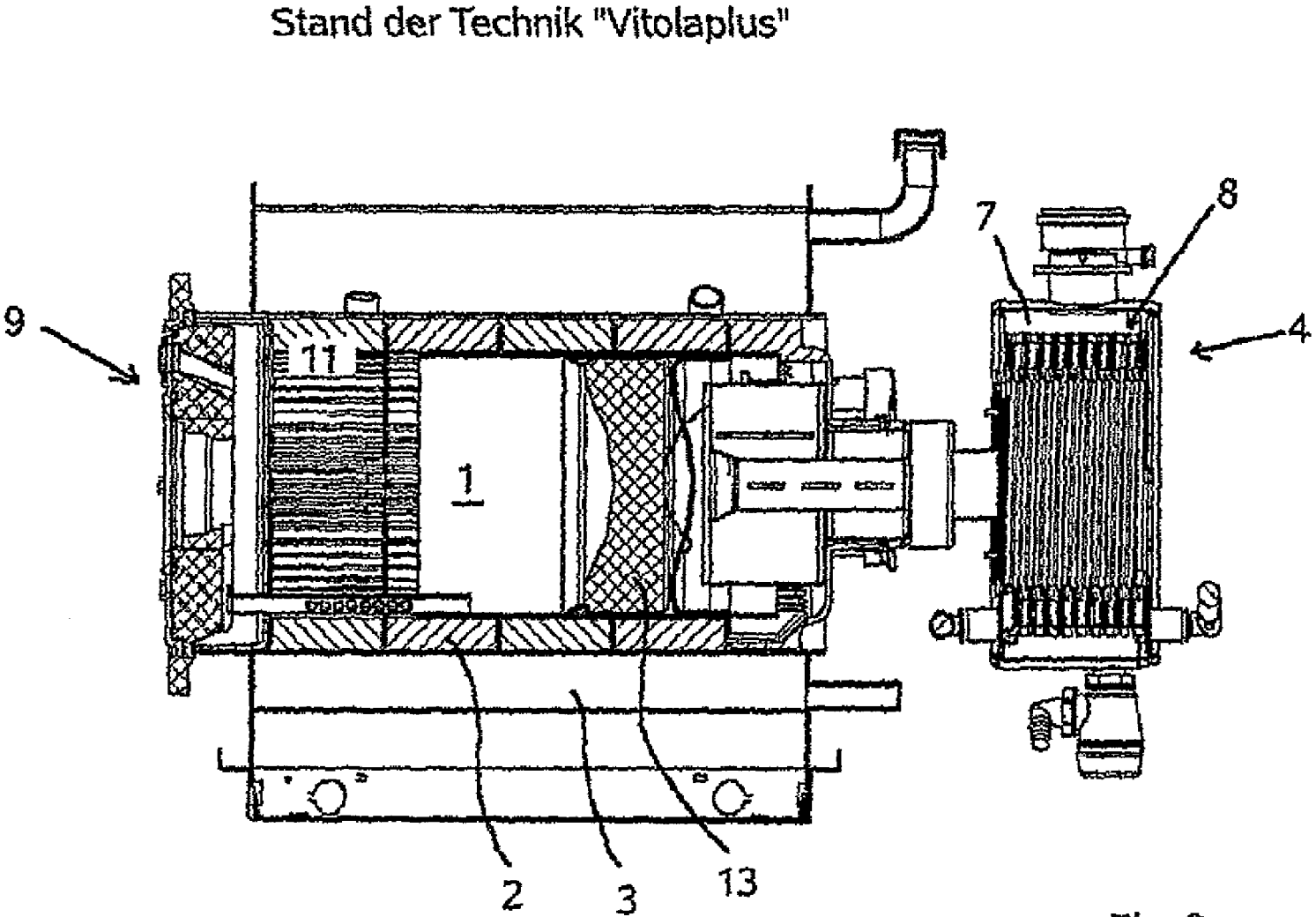
FIG. 3 shows, in sectional view, a "Vitaloplus" boiler according to the known aforementioned prior art.

As in the known prior art shown in FIG. 3, in the boiler according to the invention it is preferably provided that the secondary heat exchanger 4 is configured in the form of a helically wound tubular helix, having a flat flow gap 8 through which radial flow can take place. Furthermore, in order to avoid corrosion damage, it is provided that the secondary heat exchanger 4 is made of stainless steel. In addition, a heat insulating block 13 (for example, made of Vermiculite) is located in the combustion chamber 1 to deflect the heating gas jet.

A burner 10 (here an oil burner, but a gas burner is equally well possible) is always located on one front side 9 of the combustion chamber 1. The access 11 from the combustion chamber 1 to the combustion gas flue 2 is located, as desired, in the area of the burner-side front side 9 (see FIG. 1) or in the area of the other front side 12 facing away from the burner (see FIG. 2).

For all the embodiments of the boiler according to the invention, it is now essential that the combustion chamber 1 is surrounded at least in part by the secondary heat exchanger 4.

The aforementioned annular chamber 5 in which the combustion gas flue 2 opens out directly is preferably obtained in this case. Naturally, in an alternative embodiment of the secondary heat exchanger, a less direct flow guidance from the combustion gas flue to the secondary heat exchanger can also be provided.

In the embodiment according to FIG. 1, the secondary heat exchanger 4 surrounds the combustion chamber 1 in the area of the heat insulating block 13 and in this way absorbs the heat released by the heat insulating block 13.

For the same burn-up length of the combustion chamber as mentioned initially and as shown by a comparison with FIG. 3, the embodiment according to the invention results in a considerably more compact boiler in which the direct heat emission from the combustion chamber can be additionally used by the secondary heat exchanger. The hitherto necessary extremely expensive structure for flow guidance of the heating gas from the primary heat exchanger to the secondary heat exchanger is eliminated.

Figure 4:
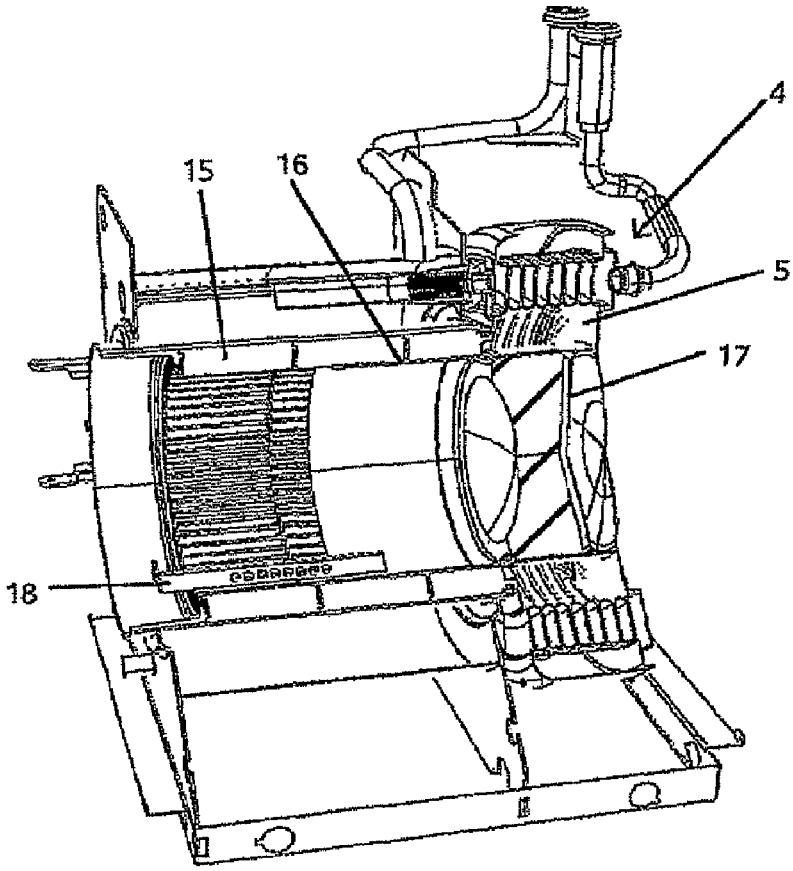
FIG. 4 shows, as a perspective section, a boiler according to the embodiment from FIG. 1 with a combustion chamber sleeve or pot inserted in the combustion chamber.
Figure 5:
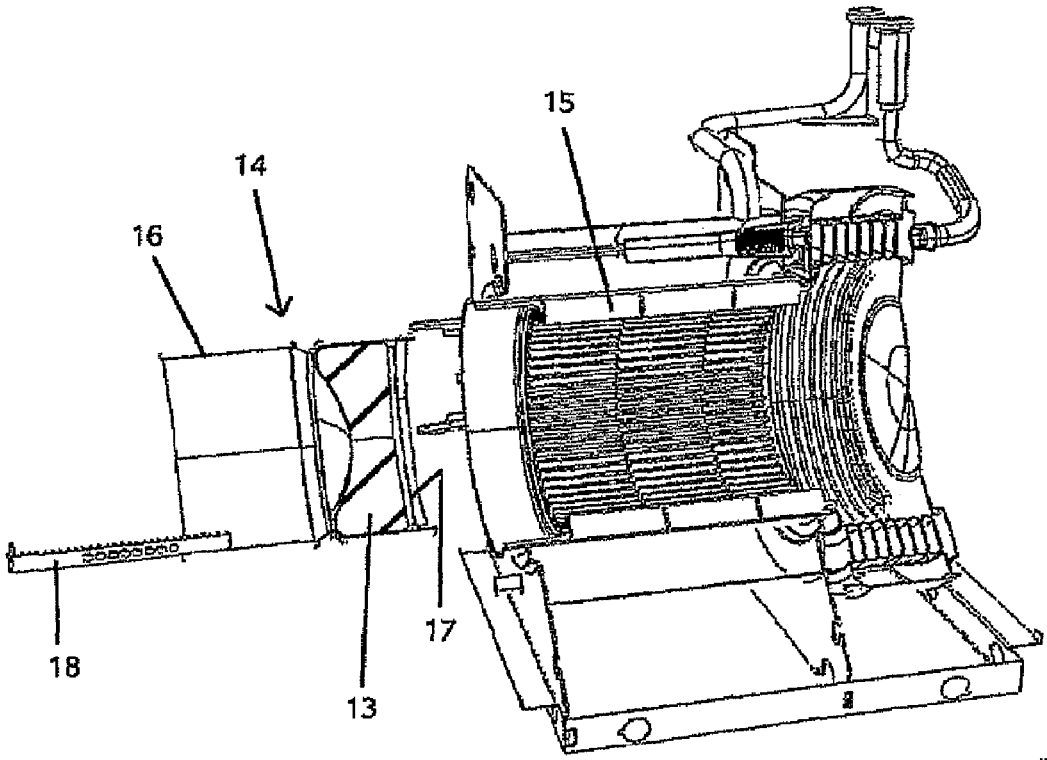
FIG. 5 shows, as a perspective section, the boiler according to FIG. 4 with the pot-type combustion chamber removed.

As can be seen particularly clearly from FIGS. 4 and 5, it is advantageously provided that the combustion chamber 1 comprises a combustion chamber sleeve 14 comprising a shell plate 16 and optionally a base plate 17 (closure plate), which are configured as withdrawable from the combustion chamber 1 in the axial direction (relative to the longitudinal axis of the cylindrical combustion chamber 1).

As can be seen from FIGS. 1 and 2 this solution is provided in principle in both embodiments (secondary heat exchanger 4 located on burner side or facing away from burner), wherein in the arrangement of the secondary heat exchanger 4 facing away from the burner (FIGS. 1, 4 and 5) the combustion chamber sleeve 14 has a base plate (closure plate) 17 on one side and is configured as a pot-type combustion chamber. The rod-shaped handle element 18 projecting (see FIG. 1) into the area of the burner 10 is used for withdrawing the pot-type combustion chamber in which the heat insulating block 13 is preferably located.

Due to the withdrawal (in the embodiment according to FIG. 2 this is easily possible after removing the burner-side terminating wall), if necessary both the combustion chamber 1 together with the combustion gas flue 2 and also the annular chamber 5 (without the combustion chamber sleeve 14, the annular chamber 5 becomes a cylindrical chamber—see FIG. 5) are easily accessible and can accordingly easily be cleaned. This possibility is not provided in the prior art shown in FIG. 3; this has proved to be particularly advantageous with regard to the boiler according to the invention.

Constructively, it is furthermore provided that the combustion chamber wall 14 forms a boundary wall of the combustion gas flue 2 and the annular chamber 5, wherein finally the combustion gas flue 2 consists of cast iron segments 15 with radially inwardly directed ribs, whose free ends rest on the combustion chamber sleeve 14 and define its position in the combustion chamber 1.

REFERENCE LIST

1 Combustion chamber
2 Combustion gas flue
3 Housing
4 Secondary heat exchanger
5 Annular space
7 Flue gas collecting chamber
8 Flow gap
9 Front side (burner side)
10 Burner
11 Access to combustion gas flue
12 Front side (facing away from burner)
13 Heat insulating block
14 Combustion chamber sleeve
15 Cast iron segments
16 Shell plate
17 Base plate
18 Handle element

The invention claimed is:

1. A boiler, comprising a combustion chamber (1) with a heat insulating block (13), wherein said combustion chamber (1) is surrounded at least in part by a combustion gas flue (2) that is embodied as a primary heat exchanger, wherein said combustion gas flue (2) is surrounded at least in part by a water-conducting housing (3), wherein a water-conducting secondary heat exchanger (4) that is hydraulically connected to the housing (3) and through which heating gas flows is mounted downstream of the combustion gas flue (2), characterised in that the combustion chamber (1) is surrounded at least in part by the secondary heat exchanger (4), wherein the combustion chamber (1) comprises a combustion chamber sleeve (14) which is configured as withdrawable from the combustion chamber (1) in the axial direction.

2. The boiler according to claim 1, characterised in that the secondary heat exchanger (4) is configured as helically tube-shaped and heating gas flows radially therethrough from inside to outside, in particular is configured in the form of a helically wound tube helix having a flat flow gap (8) through which radial flow can take place.

3. The boiler according to claim 2, characterised in that the combustion chamber (1) is surrounded by the secondary heat exchanger (4) forming an annular chamber (5).

4. The boiler according to claim 3, characterised in that the combustion gas flue (2) opens directly into the annular chamber (5).

5. The boiler according to claim 1, characterised in that the secondary heat exchanger (4) is located in a housing (6) which on the one hand defines the annular chamber (5) and on the other, another annular-chamber-shaped flue gas collecting chamber (7) surrounding the secondary heat exchanger (4).

6. The boiler according to claim 1, characterised in that a burner (10) is located on one front side (9) of the combustion chamber (1) and that an access (11) to the combustion gas flue (2) is arranged in the area of the burner-side front side (9) or in the area of the other front side (12) facing away from the burner.

7. The boiler according to claim 1, characterised in that the secondary heat exchanger (4) surrounds the combustion chamber (1) in the area of the heat insulating block (13).

8. The boiler according to claim 7, characterised in that the combustion chamber sleeve (14) has a base plate (17) on one side and is configured as a pot-type combustion chamber.

9. The boiler according to claim 8, characterised in that the heat insulating block (13) is located in the pot-type combustion chamber.

10. The boiler according to claim 1, characterised in that the combustion chamber sleeve (14) forms a boundary wall of the combustion gas flue (2) and the annular chamber (5).

11. The boiler according to claim 1, characterised in that the combustion gas flue (2) consists of cast iron segments (15) having radially inwardly directed ribs, wherein their free ends rest on the combustion chamber sleeve (14) and define their position in the combustion chamber (1).

* * * * *